United States Patent [19]

Greene et al.

[11] 3,959,611

[45] May 25, 1976

[54] PUSHBUTTON KEYBOARD SYSTEM HAVING PLURAL LEVEL WIRE-LIKE CONTACT

[75] Inventors: Herbert R. Greene, Providence, R.I.; Charles W. Balser, Attleboro, Mass.

[73] Assignee: Texas Instruments Incorporated, Dallas, Tex.

[22] Filed: Jan. 10, 1975

[21] Appl. No.: 535,921

[52] U.S. Cl. ..... 200/5 A; 200/159 B; 200/275

[51] Int. Cl.[2] ..... H01H 13/70; H01H 1/06

[58] Field of Search ..... 200/5 R, 5 A, 159 R, 200/159 B, 164 R, 242, 243, 247, 275

[56] References Cited

UNITED STATES PATENTS

| | | | |
|---|---|---|---|
| 2,522,895 | 9/1950 | Raymond | 200/275 X |
| 2,966,570 | 12/1960 | Jordan | 200/275 X |
| 3,783,205 | 1/1974 | Boulanger | 200/159 B X |
| 3,808,384 | 4/1974 | Boulanger | 200/159 B |
| 3,849,611 | 11/1974 | Walker, Jr. | 200/275 |
| 3,886,341 | 5/1975 | Forrest | 200/159 B X |

*Primary Examiner*—James R. Scott
*Attorney, Agent, or Firm*—John A. Haug; James P. McAndrews; Russell E. Baumann

[57] ABSTRACT

A keyboard system has a plurality of spaced sets of conductive members, each set including two outer U-shaped support members and a central U-shaped contact member disposed between the support members. The central member is coined to reduce the thickness of its outer portions and to dispose a central part upstanding at the center of the member. These members are arranged at a surface of an insulating support in electrical communication with conductive paths on an opposite surface of the support. A plurality of actuatable conductive elements, one for each set of conductive members, are provided to establish bridging electrical connections between the support members of the sets and the upstanding parts of the central contact members of the sets upon application of preselected deflecting forces to the conductive elements.

5 Claims, 5 Drawing Figures

PUSHBUTTON KEYBOARD SYSTEM HAVING PLURAL LEVEL WIRE-LIKE CONTACT

BACKGROUND AND SUMMARY OF INVENTION

The present invention relates to keyboard systems and more particularly is directed to an improved pushbutton keyboard system for use in electronic calculators to selectively close electrical circuits.

Keyboard systems, and particularly keyboard systems for electronic calculators such as shown in U.S. Pat. No. 3,725,907 which use metal staples as contact members have been very widely used. However, in using a system having staples as electrical contact members, there has been a problem of contamination of the contacts with particles, lint, solder flux and other air born dirt. Such contamination, which generally occurs during keyboard manufacture, can interfere with making of electrical connection to the contacts. There has also been some problem in proper spacing and alignment in using staples as the conductive contact members in a keyboard system. As a result, significantly high rejection rates have been experienced in making such keyboard systems.

Accordingly, it is an object of the present invention to provide an improved pushbutton keyboard system which is designed to minimize the effects of contaminates and to insure proper alignment of system components.

It is another object of the present invention to provide an improved pushbutton keyboard system in which actuation of individual push button members establishes positive electrical connections for transmitting electrical information.

It is yet a further object of the present invention to provide an improved pushbutton keyboard system which is relatively rugged and durable and which is extremely economical to fabricate on a mass production basis with very low rejection rates.

Other objects and features of the invention will become more readily understood from the following detailed description and appended claims, when read in conjunction with the accompanying drawings in which like reference numerals designate like parts throughout the figures thereof.

DESCRIPTION OF PREFERRED EMBODIMENTS

Figure 1:
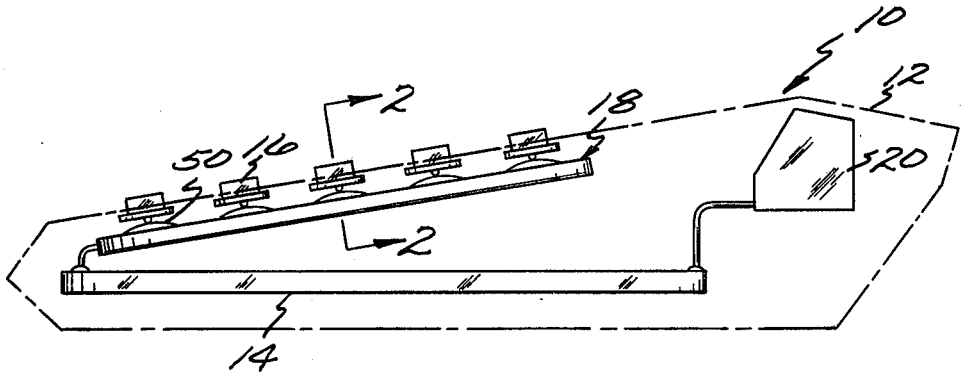
FIG. 1 is a side elevation view of a calculator in which major components of the calculator including its case, its display module and its mother board carrying various electronic logic components (not shown) and diagrammatically illustrated and in which a keyboard system of this invention is installed within the calculator case.

Referring now to the drawings, a calculator indicated in its entirety at 10, is shown to comprise a case, indicated by broken lines 12, of molded synthetic resin or the like in which various electrical apparatus or electrical components, e.g. various solid state integrated circuit and semiconductor logic components (not shown), are mounted on a mother board 14. Data is entered into the calculator by manually depressing pushbutton keys 16 of a keyboard system 18 of the present invention, and the output of data from the calculator is shown on display 20. A power supply for the calculator (not shown) is also included within the casing 12.

Figure 2:
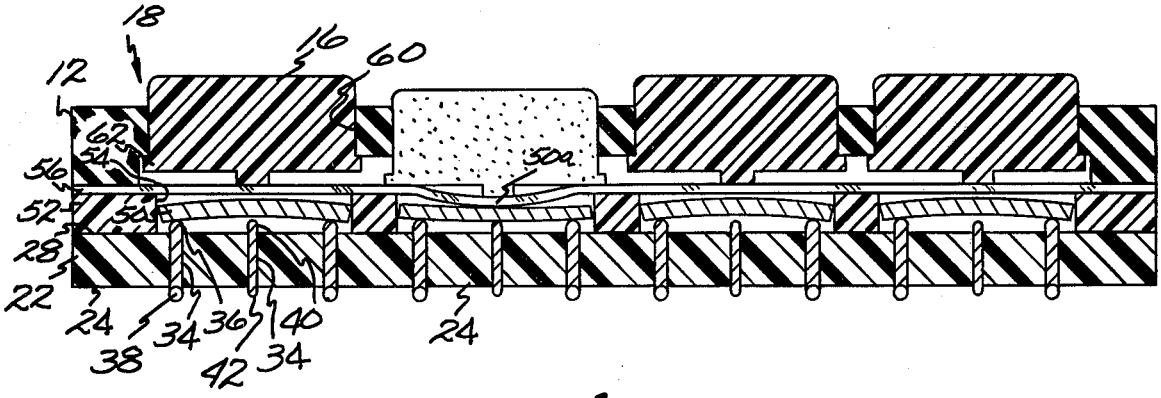
FIG. 2 is an enlarged transverse cross-sectional view taken along line 2—2 of FIG. 1.
Figure 3:
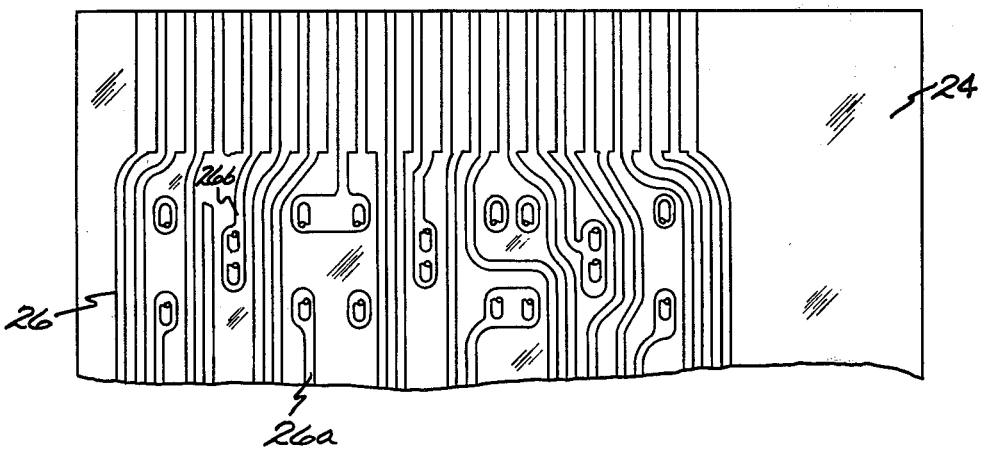
FIG. 3 is a partial plan view of the underside of the system illustrated in FIG. 2.
Figure 4:
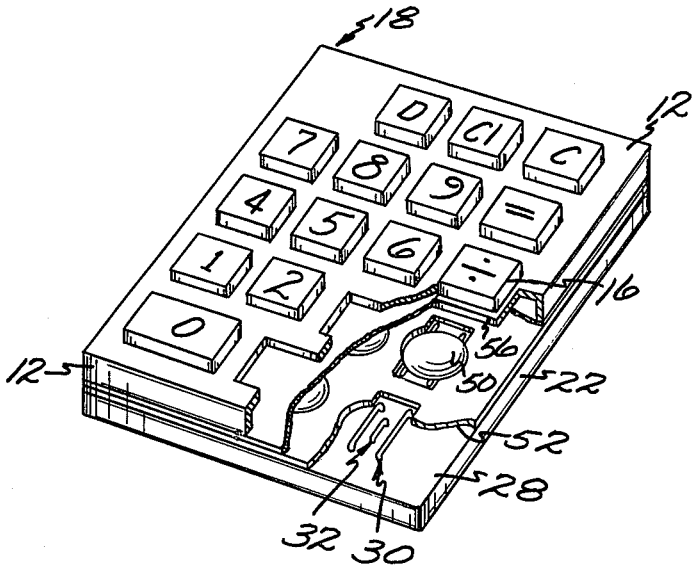
FIG. 4 is a perspective view partially cut away of a keyboard system of this invention with a top piece raised slightly for clarity.

In accordance with this invention, keyboard system 18, as best shown in FIGS. 2–4, comprises an electrically nonconductive or insulating, rigid support member 22 of molded synthetic resin material. Support member 22 has a generally planar first surface 24 as shown in FIG. 3 on which a plurality of conductive circuit paths 26 are disposed and arranged in a preselected pattern for transmitting electrical information in response to selective interconnection of portions thereof. These paths may be deposited on the surface 24 by utilizing conventional printed circuit art techniques such as masking, etching and graving etc. At a second opposite surface 28 of insulating support member 22, a plurality of sets of conductive support members 30 are arranged in a preselected configuration in electrical communication with first portions **26*a* of conductive paths 26. Similarly, conductive contact members 32 are arranged at second surface 28 in electrically isolated relationship to the conductive support members 30. The contact members 32 are in electrical communication with second portions 26b of conductive paths 26. Pairs of the conductive support members 30 cooperate with one of the contact members 32 to define a contact support set. Preferably the support members 30 and the contact member 32 comprise generally U-shaped wire staple members which are inserted through apertures 34 to extend through the thickness of support member 22 between first surface 24 and second surface 28. Preferably the diameter of the wire in support staples 30 is relatively larger than the diameter of the wire in the contact staples 32**.

Figure 5:
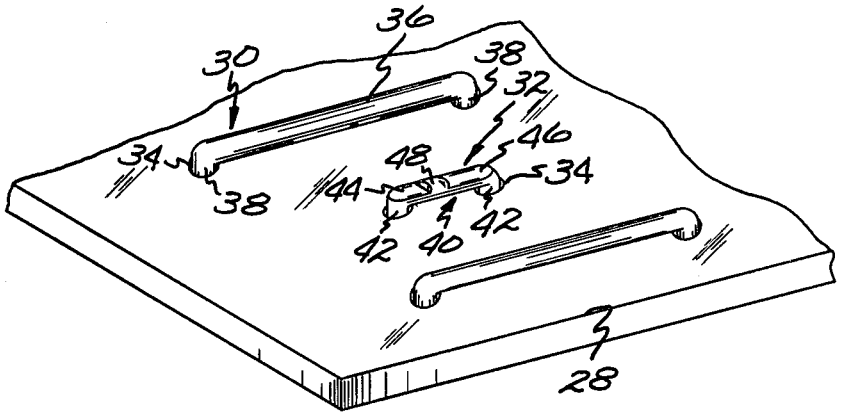
FIG. 5 is a greatly enlarged perspective view of a space set of conductive members shown in FIG. 4.

In this arrangement, as best shown in FIG. 5, conductive support staples each include a main body portion 36 of a generally cylindrical configuration terminating in a pair of legs 38 which are received within apertures 34 in support layer 22. The other ends of legs 38 are crimped against the surface 24 and are in contact with selective portions of conductive paths 26, as indicated at **26*a*. Consequently, a rigid mechanical connection is established and the electrical contact may be improved by soldering the crimped portions of the legs 38 in contact with the circuit paths at 26*a*. See FIGS. 2 and 3. Similarly, each of the associated contact members 32 also preferably comprise a main body portion 40 terminating in a pair of legs 42 which extend through apertures 34 and which are affixed to support member 22 in a similar manner in communication with the second portions 26*b* of conductive paths 26. Conductive support staples 30 and conductive contact staples 32** may be fabricated of various materials and material combinations depending upon the properties desired. Typically, the staples are fabricated of goldplated nickel wire in order to provide a relatively non-reactive material having good contact surface properties.

A retainer plate 52 of an insulating material having a plurality of apertures 54 therein is secured to the support member 22 by cementing or in any other conventional manner with the apertures 54 aligned with respective sets of the staple supports 30 and contact members 32. A plurality of selectively actuable conductive elements 50 are then arranged in the respective retainer plate apertures 54. As illustrated particularly in FIG. 2, each of the elements 50 has a normally dish-shaped configuration such as is shown at the left of FIG. 2 but is adapted to be moved to the inverted dished configuration as indicated at 50a in FIG. 2 by the application of a deflecting force to the element 50. In this arrangement of the elements 50 in the retainer plate apertures 54, each of the elements 50 normally has its marginal portions in electrical engagement with and supported by the main body portions 36 of the staple support members 30 but is normally spaced from the associated contact member 32. However, on the application of a selected deflecting force to an element 50 sufficient to move the element to its inverted dished configuration, the marginal portions of the element remain in electrical engagement with the support members 30 while the center of the element 50 moves to its over-center position with snap action to engage the contact member 32, thereby to establish a bridging electrical connection between the support members 30 and the contact 32 and to thereby effect closing of an electrical circuit between circuit paths portion 26*a* and 26*b*. Upon release of the noted deflecting force, the element 50 is adapted to move with snap-action to its original dished configuration breaking electrical engagement with the contact member 32. The conductive elements are preferably formed of gold-plated stainless steel. Preferably a thin pliable film 56 of electrically insulating material such as polyethylene terephthalate is secured to the retainer plate 52 over the apertures 54 by cementing or the like for helping to retain the selectively actuable elements 50 in the apertures 54.

Actuation of the conductive elements 50 to effect the above-noted bridging electrical connection between the supports 30 and the contacts 32 is preferably accomplished by the use of manually actuable pushbutton members 16 as best shown in FIG. 2. That is, a pushbutton support 12 having a plurality of apertures 60 is secured to the retainer plate 52 over the film 56 by cementing or the like for disposing the apertures 60 in alignment with the respective conductive elements 50. The push buttons 16 are disposed in respective apertures 60 and each push button is provided with a flange 62 for retaining the push button in an aperture 60. In this arrangement, the application of manual or finger pressure to a push button 16 transmits a preselected deflecting force through the pliable film 56 and applies this force to deflect a conductive element 50 from its original to its inverted dished configuration to effect a bridging electrical connection between a pair of supports 30 and a contact member 32, thereby to selectively interconnect circuit path portions 26*a* and 26*b*.

In accordance with this invention the main body portion 40 of the contact member 32 has a different shape from main body portion 36 of the support as shown in FIG. 5. That is, portion 40 is conveniently made from a wire as is support 36 but outside edge portions 44, 46 of the contact member wire are coined down so as to be preferably 0.003 to 0.008 inches (0.76 to 2.03 millimeters) below the center portion 48 of the wire body. That is, the center part 48 stands up from the rest of the contact member 32.

Typically, for example, the contact member 32 is provided with the upstanding central part 48 by sticking a conventional wire staple with a flat coining tool so that the end portions 44, 46 of the staple are deformed or flattened below the level of the center part of the wire staple. In a preferred technique, for example, the staples 30 and 32 are mounted on the support 22 in a desired pattern by conventional stapling techniques. The mounted staples are then struck simultaneously with a coining tool while the support 22 is firmly held in position for simultaneously forming the flattened end portions 44 and 46 on each of the contact staples.

This deforming operation on the staples 32 improves the reliability of bridging contact between conductive members 30, 32 by the actuable elements 50. That is, even if the positioning and sizing of conductive contact members 32 relative to the support members 30 is not precisely correct as initially mounted on the support 22, the deforming operation, by flattening the ends 44 and 46 of the contact staples, assures that these staple ends do not inadvertently engage or interfere with mounting of the elements 50 on the support staples 50. Further, even though there is some error in positioning of the contact staples 32 on the support 22, the center part 48 of the contact staples are positioned by the coining in axial registry with the centers of the actuable elements 50. In this regard, the support staples 30 are normally formed of larger diameter wire than the contact staples 32 so that, as the actuable elements 50 are deflected into engagement with the contact staples 32, the center part of actuable elements have space to pass "over-center " to achieve the desired "snap-action" before engaging the contact members 32. By flattening of the ends 44 and 46 of the contact member, it is assured that these staple ends do not engage the actuable elements at a location spaced from the center of the actuable elements to prevent such over-center movement.

Secondly, the deforming reduces faulty operation of the keyboard system due to the presence of contaminants. The reduced size of center contacting portion 48 necessarily provides for increased contact pressure on the contacting surface. This result increases the probability that good contact will be made even if a contaminant is present on the surface of portion 48 of the contact member. The increased pressure can break through the contaminant or knock it out of the way. Also the deforming provides valleys in which the contaminants can rest and still not effect the contacting. If the contact member were all one height then the contaminant on any part of the contact surface could cause trouble but with the deforming operation there is a major part of main body portion 40 that can have a contaminant and not effect the contacting. In a typical situation with main body portion 40 of contact member 32 at one height, a piece of contaminant can come to rest on any portion of the main body and will block proper contacting between conductive member 30, 32. With a deforming operation, the contaminant will most likely land in the coined area and not prevent proper contacting among conductive members.

Thus, a unique keyboard system has been described in detail in which a highly reliable and particularly advantageous bridging electrical contact system is provided, particularly for incorporation in electronic calculators.

Various changes and modifications in the abovedescribed embodiment will be readily apparent to those skilled in the art and any of such changes and modifications are deemed to be within the spirit and scope of the present invention as set forth in the appended claims. For example, the coining operation of reducing the height on either side of a contacting portion could be used in various keyboard systems and not just the preferred embodiment shown.

We claim:

1. A selectively energizable switch comprising a base, first and second spaced conductive means mounted in insulated relation to each other on the base, a selectively actuatable conductive element aligned with the first and second conductive means, said selectively actuatable conductive element being electrically connected to said first conductive means and being adapted upon actuation to make a bridging electrical connection between the first and second conductive means, at least said second conductive means comprising a wire-like member having deformed portions disposed at selected levels relative to said base at two opposite sides of a selected contact portion of said wire-like member disposed at a selected higher level relative to said base upstanding between said deformed portions of said wire-like member aligned with the center of said selectively actuatable conductive element to increase the probability of proper contacting said selectively actuatable conductive element on the wire-like conductive member during actuation of said selectively actuable conductive element.

2. A selectively energizable switch as set forth in claim 1 wherein said selectively actuatable conductive element is a generally circular disc-shaped element formed of a segment of a hollow body having a double curved outer surface which includes a generally convex surface of curvature when in an unactuated state.

3. A selectively energizable keyboard system comprising an electrically insulating support member having a first surface on which a plurality of conductive paths are arranged in a preselected pattern adapted to transmit electrical information in response to selective interconnection of portions of said paths, conductive support means arranged in a preselected pattern at a second opposite surface of said insulating support member in electrical communication with first preselected portions of said paths, a plurality of conductive contact staple members each having a central body portion disposed at said second surface of said support member in electrically isolated relationship with respect to said conductive support means and each having a pair of legs extending through said insulating support member to be disposed in electrical communication with second preselected portions of said paths, said body portion of each of said contact members having flat portions at a selected level adjacent said legs and having a central part between said flat portions upstanding from said flat portions, and a plurality of selectively actuatable conductive elements adjacent said second surface of said insulating support member, said element being supported by and maintained in continuous electrical contact with said conductive support means and in selected spaced relation to said respective conductive contact members, said conductive elements being adapted to be selectively deflected into engagement with said upstanding central part of said conductive contact member so as to establish an electrical connection between said first and said second preselected portions of said paths in response to the the application of a preselected deflecting force to said conductive element.

4. A selectively energizable keyboard system comprising an electrically insulating support board having a first surface carrying a plurality of conductive paths arranged in a preselected pattern and adapted to transmit electrical information in response to selective interconnection of portions thereof, a plurality of pairs of spaced, generally U-shaped, conductive support staples arranged in a preselected pattern at a second opposite surface of said support board, said support staples having the central body portions thereof disposed at said second surface to define a plurality of generally planar support areas at said surface and having the ends of each of said support staples extending through apertures in said support board and terminating in electrical contact with first preselected portions of said conductive paths, a plurality of associated conductive contact staples at said second surface, one of said associated staples being arranged intermediate the staples in each of said pairs of support staples and electrically isolated from said support staples, said contact staples each having the central body portion of said contact staples disposed at said second surface and having the ends of said contact staples extending through apertures in said support board and terminating in electrical contact with second preselected portions of said conductive paths, said central body portion of said contact staples each having flat portions at each end adjacent said legs and having a central part upstanding from said flat portions of said contact staples, a plurality of selectively actuatable, generally circular, conductive discs adapted to undergo flexing movement in response to the application of a preselected deflecting force thereto respectively disposed on said planar support areas defined by said support staples with marginal portions of said discs supported by and maintained in substantially stationary electrical contact with said respective pairs of conductive support staples and with the central portions of said discs in selective disengagement with said conductive contact staples, the central portions of each of said conductive discs being adapted to be selectively deflected into engagement with said central part of one of said conductive contact staples to establish a bridging electrical contact between a pair of support staples and its associated contact staple, thereby to electrically connect said first and second preselected portions of said conductive paths, and push button means for selectively applying said deflecting force to said conductive discs.

5. A keyboard system as set forth in claim 4 wherein said support staples each comprise a wire of selected diameter and said contact staples each comprise a wire of relatively smaller diameter, said support staples defining said planar support areas at level having having a selected spacing from said second insulating board surface and said upstanding central parts of said contact staples being disposed at a level with a relatively smaller spacing from said second board surface.

* * * * *